United States Patent [19]

Hoffman

[11] Patent Number: 4,549,732

[45] Date of Patent: Oct. 29, 1985

[54] WALKING COURSE

[76] Inventor: Michael A. Hoffman, R.D. #1, Clifton Springs, N.Y. 14432

[21] Appl. No.: 500,095

[22] Filed: Jun. 1, 1983

[51] Int. Cl.[4] ..... A63B 23/04

[52] U.S. Cl. ..... 272/70

[58] Field of Search ..... 272/70, 69, 70 A, 70.3, 272/70.4, 63, 3-5, 113, 109, 33 R; 128/25 R; 256/13.1, 21, 22, 24, 59, 65; 119/29; 273/55 R; D21/192-194, 244, 245

[56] References Cited

U.S. PATENT DOCUMENTS

| | | | |
|---|---|---|---|
| 554,179 | 2/1896 | Gerl | 272/33 R |
| 2,323,291 | 7/1943 | Bens | 273/55 R |
| 2,690,789 | 10/1954 | Zadrozny . | |
| 2,761,683 | 9/1956 | Starcliff | 272/33 R |
| 2,785,896 | 3/1957 | Ellis | 272/69 |
| 2,871,914 | 2/1959 | Timoney | 272/70 |
| 2,871,915 | 2/1959 | Hogan . | |
| 3,193,287 | 7/1965 | Robinson | 272/69 |
| 3,384,369 | 5/1968 | Rumell | 272/69 |
| 3,469,822 | 9/1969 | O'Brien . | |
| 3,819,176 | 6/1974 | Cummins | 272/63 |
| 4,068,842 | 1/1978 | Callecod | 272/113 |
| 4,114,873 | 9/1978 | Jones | 272/63 |
| 4,236,697 | 12/1980 | Savino . | |

FOREIGN PATENT DOCUMENTS

| | | | |
|---|---|---|---|
| 2852777 | 6/1979 | Fed. Rep. of Germany | 119/29 |

*Primary Examiner*—Richard J. Apley
*Assistant Examiner*—S. R. Crow
*Attorney, Agent, or Firm*—Stonebraker, Shepard & Stephens

[57] ABSTRACT

A walking course 10 has a generally oblong base 11 with a perimeter handrail 15 mounted on base 11 and extending around a closed and generally oval walking path. A central handrail 20 also mounted on base 11 extends along the inside of the walking path. A gate 25 in perimeter handrail 15 allows a person to enter walking course 10 from outside base 11; and base 11, handrails 15 and 20, and gate 25 are dimensioned so that a person can enter the path and walk round and round the path for exercise while gripping and guiding on both of handrails 15 and 20. Gate 25, which can be latched closed for safety while a person is using course 10, also preferably includes a seat 30 for resting if necessary.

13 Claims, 2 Drawing Figures

WALKING COURSE

BACKGROUND

Physically disabled people need handrail support for walking exercise, and they presently use parallel bars that extend along a walking length and are open ended. Some patients find it difficult to turn around at the open ends of parallel bars. Also, someone must be present while patients are using parallel bars to be sure that no one walks out of an open end and falls or gets hurt.

I have devised a walking course that patients can use unattended. My device is also simple, readily portable, and easy to use. It can be divided into two pieces that each fit into a standard sized hospital elevator. It greatly reduces the expense and increases the effectiveness of providing safe walking exercise for physically disabled people.

SUMMARY OF THE INVENTION

My walking course has a generally oblong base with a perimeter handrail mounted on the base and extending at handrail height around the outside of a generally oval walking path around the base. A central handrail is also mounted on the base and extends at handrail height along the inside of the walking path. A gate in the perimeter handrail allows entering the path from outside the base; and the base, handrails, and gate are dimensioned so that a person can enter the path and walk round and round the path for exercise while gripping and guiding on both of the handrails. The gate preferably includes a seat for resting if necessary; and the base and perimeter handrail preferably divide into two parts, each of which can fit within a standard hospital sized elevator.

DRAWINGS

FIG. 1 is a perspective view of a preferred embodiment of my walking course; and FIG. 2 is an exploded perspective view of the walking course of FIG. 1 shown partially disassembled for movement.

DETAILED DESCRIPTION

Figure 1:
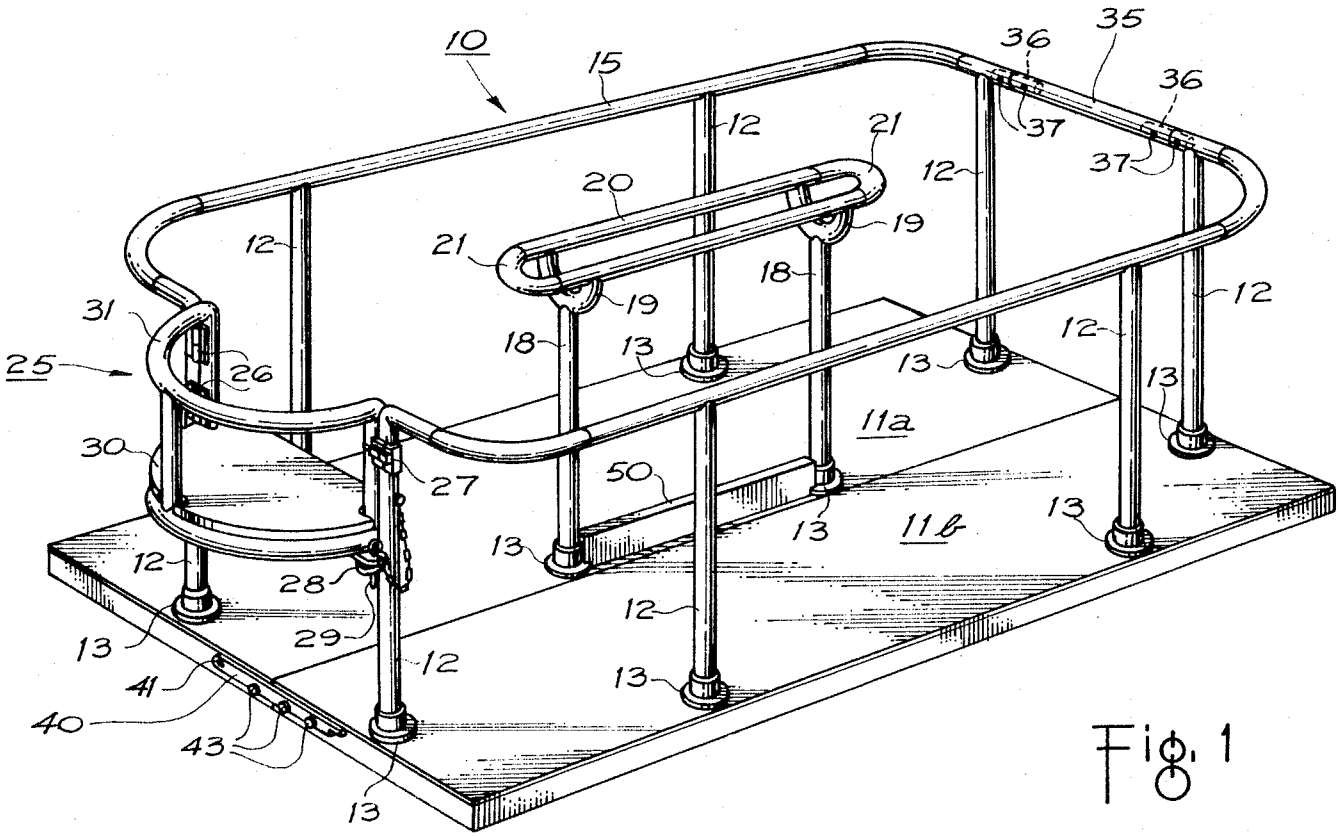
Figure 2:
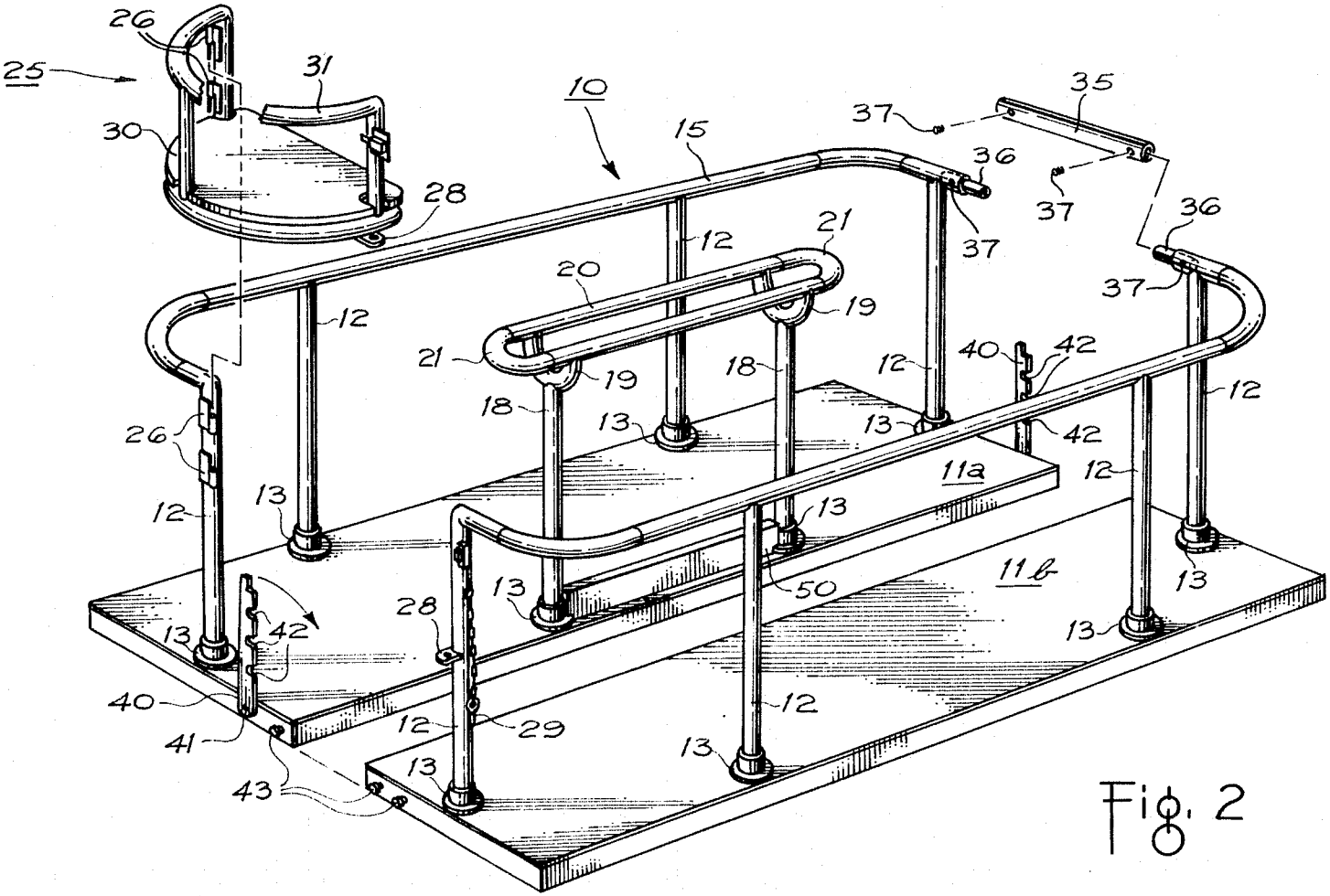

My walking course 10 has a base 11 formed of two parts 11*a* and 11*b*. I form each of the base portions of plywood with an underlying two-by-four frame, but other alternatives and materials are possible. Base portion 11*a* is preferably about eight feet long and wider than base portion 11*b*. When the course is separated for movement as shown in FIG. 2, each base portion and its associated handrail structures can be fitted within a standard hospital sized elevator.

To keep base portions 11*a* and 11*b* securely attached and aligned, I prefer a pair of bars 40 that are pivotally mounted on screws 41 and have notches 42 for fitting under the heads of screws 43. Raising bars 40 allows base portions 11*a* and 11*b* to be separated, and lowering bars 40 to slide notches 42 under the heads of screws 43 securely holds the base portions together in longitudinal alignment.

A perimeter handrail 15 and a central handrail 20 are mounted at a handrail height (preferably about three feet for adults) above the base. Perimeter handrail 15 is supported by a plurality of verticals 12 that have flanges 13 screwed to base portions 11*a* and 11*b*. Handrails and uprights are preferably both formed of pipe, although other materials could be used.

Perimeter handrail 15 extends around the outside of base 11 and encloses a generally oval walking path around base 11. Central handrail 20 extends around the inside of the walking path and is preferably formed as an oblong loop having curved ends 21. Yokes 19 at the upper ends of a pair of central verticals 18 provide sturdy support for central handrail 20. Verticals 18 are mounted along the inner edge of wider base portion 11*a*.

A foot barrier 50 preferably extends between center uprights 18 to a height of a few inches above base portion 11*a* to keep a person's feet out from the space between uprights 18. This prevents anyone from catching his foot on an upright 18 while approaching an end curve in the walking path.

A gate 25 in perimeter handrail 15 can open to provide for entering and leaving the walking course and can be closed when the course is in use. Gate 25 is hinged on one side by separable hinges 26 so that gate 25 can be lifted off its hinges 26. A latch 27 and a bracket 28 locked with a removable pin 29 can hold gate 25 closed. Many alternatives are possible for conveniently opening and closing and removing gate 25 to make the walking course easy to use.

Gate 25 is also preferably curved as illustrated and includes a seat 30 facing the path for resting if necessary. The curved rail 31 of gate 25 forms a bulge in perimeter handrail 15 and also serves as a back rest for seat 30.

Opposite gate 25 is a removable bar 35 in perimeter handrail 15. Bar 35 is preferably an open ended pipe of the same diameter as the pipe used for perimeter handrail 15, and it is preferably removably mounted on smaller internal pipes 36 that span the junction between bar 35 and handrail 15 and are held in place by set screws 37. By removing the inner pair of set screws 37, bar 35 can be slid free of inner pipes 36 as base portions 11*a* and 11*b* are separated. Many other possibilities exist for removing and replacing a bar 35 or other device that allows handrail 15 to be separated when the walking course is divided in two. It is also possible to make my walking course dividable into three or more parts, especially if it is made larger than the one illustrated.

To assemble walking course 10, I position base portions 11*a* and 11*b* next to each other and slide them together as removable bar 35 is positioned over pipes 36. Turning in set screws 37 holds bar 35 securely in place as a continuous span in perimeter handrail 15. Lowering bars 40 under screw heads 43 completes the attachment of the base portions. Then seat 25 is positioned on its hinges 26 and the course is ready for use.

A patient can be wheeled up to the open gate 25 with a wheelchair facing into the gate opening. When the wheelchair wheels contact the base, the patient is positioned for rising out of the wheelchair with the help of perimeter handrail 15 to a position standing on the base at the entry to the walking path.

The patient can then walk along the path between the perimeter handrail 15 and the central handrail 20 while guiding and gripping the handrails for support. Gate 25 can be closed and latched behind the patient who cannot then accidentally wander out of the walking course. The curved ends 21 on central handrail 20 help guide a person around the turns at each end of the walking path, and foot barrier 50 ensures that a person using the course does not accidentally catch a foot against center uprights 18 supporting handrail 20. If the patient needs to stop and rest, seat 30 in gate 25 is available for that. A physically disabled person can then be left safely unattended for walking exercise.

I claim:

1. A walking course for physically disabled people, said walking course comprising:

a. a generally oblong base;

b. a perimeter handrail mounted on said base and extending at handrail height around the outside of a generally oval walking path on said base;

c. a central handrail mounted on said base and extending at said handrail height along the inside of said walking path;

d. an openable and closable gate in said perimeter handrail for entering said path from outside said base; and e. said base, said handrails, and said gate being dimensioned so that a person can enter said path on said base and walk around said path for exercise while gripping and guiding on both of said handrails.

2. The walking course of claim 1 wherein said base is separable in two parts, each of which is dimensioned to fit within a hospital elevator.

3. The walking course of claim 2 wherein one portion of said base is wider than another portion of said base and said central handrail is mounted on said wider base portion.

4. The walking course of claim 2 wherein said gate and a removable bar in said perimeter handrail opposite said gate divides said perimeter handrail into separable parts secured to said base parts.

5. The walking course of claim 1 wherein said central handrail is formed as an oblong loop having curved ends.

6. The walking course of claim 1 wherein said central handrail is supported by pair of uprights secured to said base, and a foot barrier raised from base extends between said uprights.

7. The walking course of claim 6 wherein said central handrail is formed as an oblong loop having curved ends.

8. The walking course of claim 1 wherein said gate includes a seat facing said path for resting.

9. The walking course of claim 8 wherein said base is separable in two parts, each of which is dimensioned to fit within a hospital elevator.

10. The walking course of claim 9 wherein one portion of said base is wider than another portion of said base and said central handrail is mounted on said wider base portion.

11. The walking course of claim 10 wherein said gate and a removable bar in said perimeter handrail opposite said gate divides said perimeter handrail into separable parts secured to said base parts.

12. The walking course of claim 8 wherein said central handrail is formed as an oblong loop having curved ends.

13. The walking course of claim 12 wherein said central handrail is supported by pair of uprights secured to base, and a foot barrier raised from base extends between said uprights.

* * * * *